US008808460B2

(12) United States Patent
Preiss

(10) Patent No.: US 8,808,460 B2
(45) Date of Patent: Aug. 19, 2014

(54) INTELLIGENT CONTROL OF A BOTTLE WASHER

(75) Inventor: Johannes Preiss, Regensburg (DE)

(73) Assignee: Krones AG, Neutraubling (DE)

( * ) Notice: Subject to any disclaimer, the term of this patent is extended or adjusted under 35 U.S.C. 154(b) by 407 days.

(21) Appl. No.: 13/186,522

(22) Filed: Jul. 20, 2011

(65) Prior Publication Data

US 2012/0017941 A1 Jan. 26, 2012

(30) Foreign Application Priority Data

Jul. 20, 2010 (DE) ..... 10 2010 031 564

(51) Int. Cl.

| | |
|---|---|
| ***B08B 7/04*** | (2006.01) |
| ***B08B 9/00*** | (2006.01) |
| ***B08B 9/20*** | (2006.01) |
| ***B08B 9/46*** | (2006.01) |

(52) U.S. Cl.

CPC .... *B08B 9/20* (2013.01); *B08B 9/46* (2013.01)

USPC ..... 134/18; 134/25.2; 134/25.4; 134/23

(58) Field of Classification Search

CPC ..... B67C 7/00; B08B 3/126; B08B 9/08; B08B 9/20; B08B 9/205; B08B 9/46; B08B 2209/08; A47L 15/00; A47L 15/018; A47L 15/4295; A47L 15/46

USPC ..... 134/18, 22.1, 22.18, 23, 25.4, 56 R, 134/57 R, 57 D, 56 D, 58 R, 58 D, 166 R, 25.2

See application file for complete search history.

(56) References Cited

U.S. PATENT DOCUMENTS

| | | | | |
|---|---|---|---|---|
| 4,280,624 | A * | 7/1981 | Ford | 209/524 |
| 4,750,035 | A * | 6/1988 | Chang et al. | 348/127 |

(Continued)

FOREIGN PATENT DOCUMENTS

| | | | |
|---|---|---|---|
| CN | 1063162 | A | 7/1992 |
| CN | 101011701 | A | 8/2007 |

(Continued)

OTHER PUBLICATIONS

Notification of First Office Action, The State Intellectual Property Office of P.R. China, Application No. 201110204447.7, dated Aug. 2, 2013.

(Continued)

*Primary Examiner* — Alexander Markoff

(74) *Attorney, Agent, or Firm* — Marshall, Gerstein & Borun LLP

(57) ABSTRACT

Method of cleaning containers, in particular bottles of glass or plastics, in a cleaning module with a cleaning machine where at least one cleaning medium is allowed to act on the containers transported through the cleaning machine, and with an inspection unit, including determining at least one control parameter with respect to the degree of soiling of the cleaned bottles, detecting the degree of soiling of the cleaned bottles, evaluating the detected degree of soiling of the cleaned bottles in view of the at least one control parameter with respect to the degree of soiling, returning bottles evaluated to exhibit an excessive degree of soiling to the inlet of the cleaning machine, and automatically controlling the cleaning parameters of the cleaning machine if the number of returned bottles, based on the number of cleaned bottles, exceeds a predetermined target value or target range.

6 Claims, 3 Drawing Sheets

(56) References Cited

U.S. PATENT DOCUMENTS

| | | | | |
|---|---|---|---|---|
| 4,830,192 | A * | 5/1989 | Plester et al. | 209/3.1 |
| 4,858,768 | A * | 8/1989 | Plester | 209/3.1 |
| 5,067,616 | A * | 11/1991 | Plester et al. | 209/3.1 |
| 5,662,226 | A * | 9/1997 | Till | 209/2 |
| 2002/0073652 | A1 * | 6/2002 | Wiedemann | 53/425 |
| 2006/0037286 | A1 * | 2/2006 | Bernhard | 53/281 |
| 2008/0314476 | A1 * | 12/2008 | Bernhard | 141/129 |
| 2009/0255603 | A1 * | 10/2009 | Schiller et al. | 141/1 |
| 2010/0116295 | A1 * | 5/2010 | Molitor et al. | 134/23 |

FOREIGN PATENT DOCUMENTS

| | | | |
|---|---|---|---|
| CN | 101611303 | A | 12/2009 |
| CN | 101683651 | A | 3/2010 |
| DE | 2521856 | A1 | 11/1976 |
| DE | 7528063 | U | 2/1977 |
| DE | 227682 | A1 | 9/1985 |
| DE | 4322870 | C1 | 9/1994 |
| DE | 19626137 | A1 | 1/1998 |
| DE | 102006009282 | A1 | 9/2007 |
| DE | 102009039762 | A1 | 3/2011 |
| EP | 0672615 | A1 | 9/1995 |
| EP | 1813358 | A2 | 8/2007 |
| WO | WO-9210745 | A1 | 6/1992 |

OTHER PUBLICATIONS

Search Report for EP11174716, dated Aug. 6, 2012.
English translation of search report, State Intellectual Property Office of the People's Republic of China, Chinese patent application No. 201110204447.7, dated Jul. 24, 2013.
English translation of search report, German Patent Office, German Patent Application No. DE 102010031564.8, dated Jul. 20, 2010.

* cited by examiner

INTELLIGENT CONTROL OF A BOTTLE WASHER

CROSS-REFERENCE TO RELATED APPLICATION

The present application claims the benefit of priority of German Application No. 102010031564.8, filed Jul. 20, 2010. The entire text of the priority application is incorporated herein by reference in its entirety.

FIELD OF THE DISCLOSURE

The disclosure relates to a method and to a cleaning machine, such as for bottle or container cleaning, for beverage bottling operations.

In industrial cleaning (cleaning of buildings, washing machines for objects, container and bottle cleaning, etc.), the working mechanism by means of which cleaning courses are organized and executed is often represented in the so-called Sinner Circle. This representation can also be employed in the present technical field of cleaning containers and bottles, in particular returnable bottles. The Sinner Circle here comprises, as represented in FIG. 3, four cleaning parameters: mechanics, temperature, time (of action), and chemicals. Corresponding to the Sinner Circle, changes of one of the four parameters are linked to changes of at least one of the three other cleaning parameters.

In cleaning operations, for example of bottles, a reduction of the cleaning parameter of "chemicals", that is cleaning with reduced amounts of chemicals or even without any chemicals, is often particularly desirable as it can involve considerable reductions in costs. Chemicals used in the cleaning process must be removed without leaving any residues before a filling process is performed. This involves a lot of costs for cleaning the bottles, where high water and energy demands for heat generation are required per container to be cleaned. Other considerable indirect additional costs can arise if, for example, not completely removed chemicals necessitate recalls of contaminated, already filled bottles. A consequence of this also is that a reduction of chemicals can permit a reduction of the heat to be employed, which in turn permits a clear saving of costs.

In bottle cleaners, the bottles to be cleaned are often not differentiated by their degrees of soiling. So, a "clean" bottle in a returnable crate is cleaned with the same parameters as a severely soiled bottle.

In DE 10 2009 039 762, a method of cleaning containers, in particular glass or plastic bottles, is described in which the containers are cleaned in a cleaning machine with at least one cleaning medium in at least one station preferential for the cleaning result and/or in a procedure step with essentially chemical-free cleaning media which can comprise a granular material transported under pressure with compressed air or compressed water, in particular granular ice. To carry out the method, the cleaning machine comprises, downstream of an unpacking and presoaking station, a pre-cleaning station with a high pressure water blasting pre-cleaning section, and subsequently an intensive cleaning station with an intensive cleaning section to which a pressure blasting system for chemical-free, granular material and a carrier medium are associated, a disinfection station following the intensive cleaning station.

The cleaning parameters can be adjusted manually by the user of the bottle washer. With respect to the mentioned saving of costs, the setting of the cleaning parameters should be as efficiently as possible, for example by means of automatic control.

Here, aspects of the process efficiency and/or the cleaning effect of the employed material should be taken into consideration, just as thresholds or target ranges or target parameters as of which a bottle is to be evaluated as being cleaned, not cleaned or no longer cleanable. An error rate with respect to not sufficiently cleaned bottles that exit from the cleaning machine/a cleaning module at their outlet, that means bottles that have not been sufficiently cleaned despite automated control, should be reduced to nearly zero.

SUMMARY OF THE DISCLOSURE

With the present disclosure, in particular a "worst case" cleaning should be prevented, meaning a cleaning under the assumption that the highest degree of soiling is present. Savings in the use of energy and media and an optionally retrofittable process for already existing bottle washers/cleaning machines can be provided.

The disclosure provides a method for cleaning containers, in particular bottles of glass or plastics, in a cleaning module with a cleaning machine, in which in at least one procedure step, at least one cleaning medium is allowed to act on the containers transported through the cleaning machine, and with a control unit, the method comprising the following steps: determining at least one control parameter with respect to the degree of soiling of the cleaned bottles; detecting the degree of soiling of the cleaned bottles; evaluating the detected degree of soiling of the cleaned bottles and returning bottles evaluated as exhibiting an excessive degree of soiling to the inlet of the cleaning machine; automatically controlling the cleaning parameters of the cleaning machine if the number of returned bottles ($n_5$), based on the number of cleaned bottles, ($n_3$) exceeds a predetermined target value or target range.

The basic idea of the present disclosure thus is an intelligent automated control of a cleaning machine or a cleaning system depending on the number of returned bottles. Here, returned bottles are those bottles which, after they have passed through the bottle washer, must be fed again to the container inlet of the bottle washer, for example because, after a completed cleaning step, a bottle inspection/control station has evaluated the cleanliness of the cleaned bottles corresponding to at least one, preferably changeable and/or controllable, inspection/cleanness parameter, as not being sufficient.

This results in the advantage that bottles/containers that do not satisfy a provided criterion of cleanness can be cleaned again. It should be understood here that a certain number of multiple rinsing and cleaning can be absolutely desired, depending on the concrete application, the medium degree of soiling of the bottles and the employed bottle material. If, however, the number of returned bottles exceeds a predetermined target value or target range, possibly including low tolerances over a certain time, for example a short time, the system typically reacts correspondingly to reduce again the corresponding number of returned bottles.

The method can furthermore comprise: automatically controlling the cleaning parameters of the cleaning machine if the number of returned bottles ($n_5$), based on the number of cleaned bottles ($n_3$), exceeds the predetermined target value or target range.

Corresponding to the selected applications, it can be desirable that always a given number of bottles is returned, so that, if the given target value or target range is fallen below, the automatic control also reacts to increase the number of returned bottles again.

Furthermore, the method can also comprise: setting at least one further control parameter with respect to a sorting out of cleaned bottles; detecting the state of the cleaned bottles; evaluating the detected state of the cleaned bottles in view of the at least one further control parameter with respect to the sorting out, and sorting out bottles for which the at least one further control parameter is exceeded; automatically controlling the cleaning parameters of the cleaning machine if the number of sorted out bottles ($n_6$), based on the number of cleaned bottles ($n_3$), exceeds a predetermined target value or target range.

While, depending on the employed material, systems in which the number of bottles to be sorted out from the (automatically) run system is (very) low, so that this can be done by simple, optionally manual, inspection, are possible, in other applications, conditions can prevail already after the cleaning step which may make it suitable to be able to control the number of bottles to be discharged. Here, discharged bottles are those bottles which, corresponding to at least one controllable discharge parameter or range, are discharged from the automatically controlled cleaning system, that means which are neither directed to the bottle outlet nor again to the bottle inlet, and instead must be further treated separately, if provided, or else must be sorted out, that means can no longer be used. So, the advantage is that these bottles to be specially rated can also be automatically sorted out of the system. Here, one or several control parameters, such as, for example, scratches, cracks, damages, severe optical opaqueness, in plastic containers also deformations, buckling, holes, etc., are consulted for a corresponding evaluation.

The above method can furthermore comprise: automatically controlling the cleaning parameters of the cleaning machine if the number of returned bottles ($n_6$), based on the number of cleaned bottles ($n_3$), falls below the predetermined target value or target range.

It can be equally reasonable within the scope of the method, possibly supported by experience, that it should be possible to withdraw a certain number of bottles from the system, so that, if the at least one discharge parameter or range is fallen below, the automatic control can correspondingly cause the number of bottles to be sorted out to approach again this parameter or range.

Here, the automatic control of the cleaning parameters of the cleaning machine can be effected by means of a fuzzy logic system. So, the system can vary the cleaning parameters in an intelligent and self-learning manner to optimize it. That means, with a fuzzy logic system, the control function and its effects on the further process can be particularly efficiently optimized in view of the cleaning intensity in a self-learning manner.

In the automatic control of the cleaning parameters, the Sinner Circle can be typically taken into consideration. Corresponding to the Sinner Circle, changes of one of the four parameters, i.e. mechanics, temperature, time and chemicals, can be compensated, for example with respect to an optimization, by changing at least one of the three other cleaning parameters. By this, an efficient control of the cleaning machine can be ensured.

The disclosure furthermore comprises a cleaning module for containers, in particular bottles of glass or plastics, with at least one conveyor section, with a cleaning machine, with at least one return section, with a control unit, with a discharge unit, and with a return unit, where the control unit is designed such that it can detect the degree of soiling of the cleaned bottles, evaluates the detected degree of soiling of the cleaned bottles in view of at least one control parameter with respect to the degree of soiling, and directs bottles with an excessive degree of soiling to the return unit corresponding to the evaluation; where the cleaning parameters of the cleaning machine are automatically controlled if the number of the bottles ($n_5$) sorted out into the return unit, based on the number of cleaned bottles ($n_3$), exceeds a predetermined target value or target range.

So, the cleaning module for containers can be controlled intelligently and automatically as a modular unit, depending on the number of returned bottles. So, if too many bottles are sorted out into the return unit, the system becomes less efficient, and the intelligent control can react correspondingly, so that efficiency can be increased again.

Here, the control unit can be designed, in a further development, to automatically control the cleaning parameters of the cleaning machine if the number of bottles ($n_5$) sorted out into the return unit, based on the number of cleaned bottles ($n_3$), falls below a predetermined target value or target range. There can in particular be experience values according to which further cleaning of a certain percentage of bottles optimizes the efficiency of the employed machine.

Furthermore, the control unit of the above-described cleaning module can be designed such that it detects the state of the cleaned bottles; evaluates the detected state of the cleaned bottles in view of the at least one further control parameter with respect to the sorting out of the bottles, and sorts bottles out to the discharge unit if the evaluation of the state of the bottles results in a sorting out of the bottles. The control unit is furthermore designed such that it can automatically control the cleaning parameters of the cleaning machine if the number of sorted out bottles ($n_6$), based on the number of cleaned bottles ($n_3$), exceeds a predetermined target value or target range. So, if the number of bottles to be sorted out rises, one can react to this circumstance. Here, extreme soiling or also mechanical problems of the machine can be taken into consideration.

Here, a further development of the control unit can comprise: automatically controlling the cleaning parameters of the cleaning machine if the number of sorted out bottles, $n_6$, based on the number of cleaned bottles ($n_3$) falls below the predetermined target value or target range. Here, too, experience values can exist which indicate that it can be efficient to be able to sort out a typically very low number of bottles during the process. In this case, too, efficiency can be increased.

In the cleaning module, the automatic control of the cleaning parameters of the cleaning machine can be typically accomplished by means of a fuzzy logic system whose advantages have been already illustrated in view of the effective automatic learning.

Furthermore, in the automatic control of the cleaning parameters, the Sinner Circle can be taken into consideration. The consideration of the mutual dependency of the parameters in the Sinner Circle can ensure a particularly efficient control of the cleaning machine.

The disclosure moreover provides a cleaning system with cleaning modules as described above, designated with RM1, . . . RMm. So, the modularity of the cleaning modules permits to connect a desired number of modules in series, where each module is controlled automatically.

Here, the cleaning system can be provided with a control unit for controlling the cleaning parameters of the cleaning modules RM1, . . . , RMm.

In a cleaning system which comprises, for example, several cleaning stations with different degrees of intensity (pre-cleaning, intensive cleaning, recleaning, disinfection, etc.), such an automated control can be carried out directly following a respective cleaning station. Furthermore, it is also possible that individual cleaning stations can be weighted more than other ones. In particular, by an intelligent automated control, the linkage of the cleaning stations, that means the total number of incoming bottles upstream of a respective station and the time provided for a respective cleaning step within a station can be taken into consideration in the control of the overall system. Here, a fuzzy logic system can also be employed.

BRIEF DESCRIPTION OF THE DRAWINGS

The subject matter of the disclosure will be explained with reference to the following drawings. In the drawings.

DETAILED DESCRIPTION OF THE PREFERRED EMBODIMENT

Figure 1:
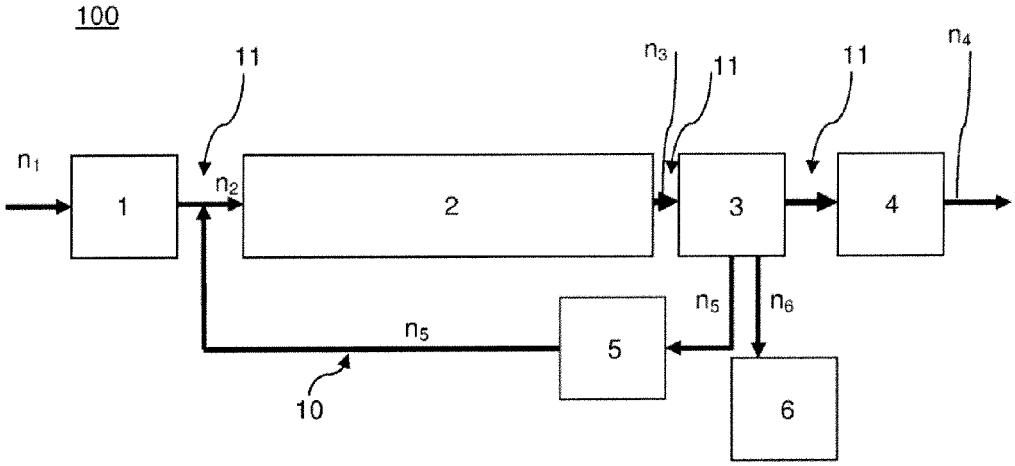
FIG. 1 shows a representation of a cleaning module according to the disclosure corresponding to an embodiment of the present disclosure.

A cleaning module 100 schematically shown in FIG. 1 with a cleaning machine 2, for example serves to clean containers, in particular bottles, which are at least predominantly returned by consumers and refilled according to the multi-cycle principle. These can especially be plastic or glass bottles for the beverage industry for which very high cleaning and hygienic standards must be observed for their refilling. For the sake of simplicity, reference will hereinafter be made only to bottles. Here, this term can always also mean containers or objects that can be filled.

In the cleaning module 100 shown in FIG. 1, bottles are supplied to the running-in area 1, for example with a conveyor medium, for example a primary conveying belt or conveying section 11. The direction of conveyance is indicated in FIG. 1 by the arrows.

Figure 3:
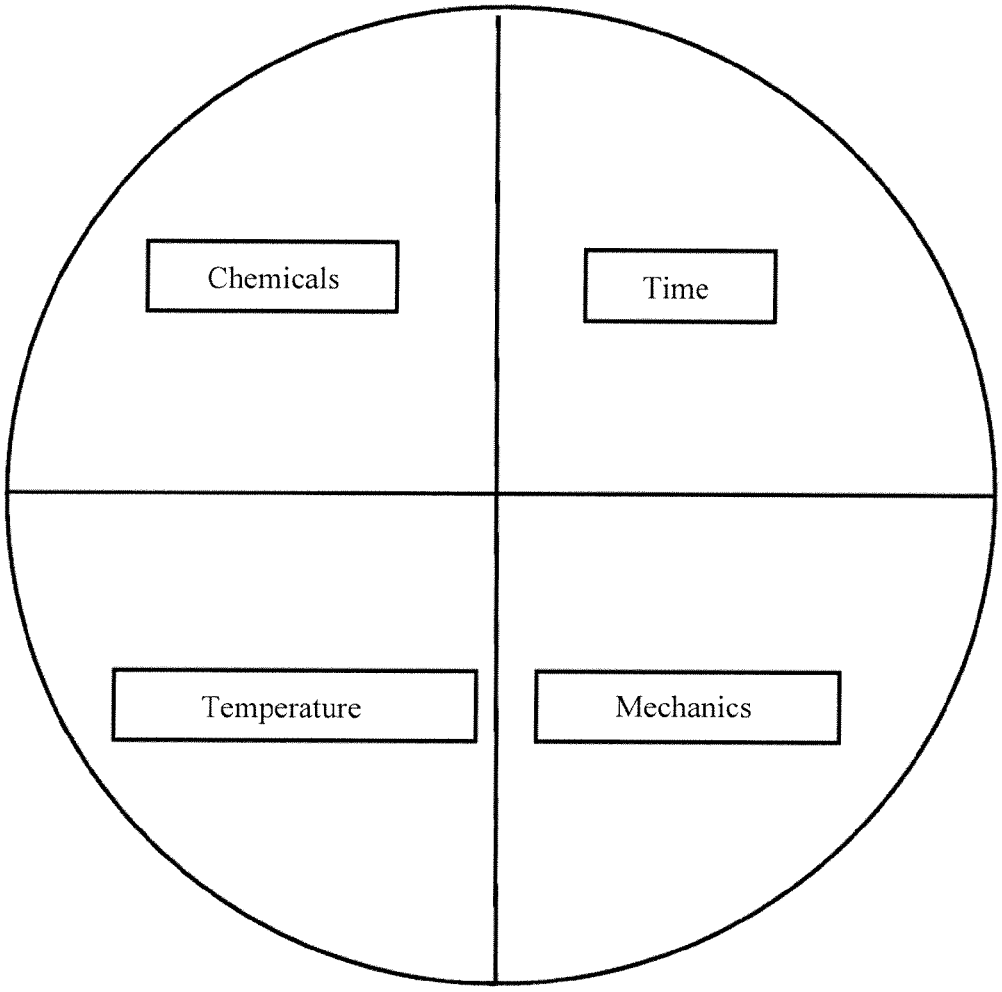
FIG. 3 shows a representation of the Sinner Circle with four cleaning parameters.

The cleaning machine 2 of the cleaning module 100 is a cleaning machine in which by means of well-known modern methods, at least one cleaning step for the bottles to be cleaned can be performed, so that the degree of soiling of the bottles running into the bottle inspection unit 3 is typically clearly lower as compared to the bottles running into the cleaning machine 2. Here, the cleaning parameters of the cleaning machine 2 can be typically adjusted corresponding to the Sinner Circle, see FIG. 3. The cleaning parameters shown in FIG. 3 are chemicals, time, temperature and mechanics. For example, intensive cleaning can require the use of more chemicals or a longer time of action. A mechanical treatment by brushes or the use of steam jets, preferably at high pressures, increases the application of the parameter of mechanics, but can help to reduce the parameter of chemicals or time. The parameter of temperature, for example in the form of hot water, can help to shorten the time of cleaning.

The bottle inspection unit 3 of the cleaning system evaluates, by automatic inspection, the degree of soiling and/or the overall state of the bottles running into the bottle inspection unit 3. So, the unit 3 detects the achieved cleanness or the remaining degree of soiling of the bottles, respectively. Furthermore, the unit 3 can detect defective bottles (for example cracks, major scratches, etc.). The unit 3 evaluates the degree of soiling of the cleaned bottles compared to a predetermined, adjustable control parameter with respect to the degree of soiling. Bottles which are not defective but whose degree of soiling exceeds the predetermined degree of soiling can be fed again to a cleaning process by the cleaning machine 2 via the bottle return unit 5 and the return section 10, where these bottles can be added in addition to the bottles arriving in the running-in area 1. Bottles which are evaluated as containers that can no longer be cleaned in an automated manner, are defective or can no longer be (automatically) recycled after at least one further adjustable control parameter can be forwarded to the discharge unit 6, for example be collected there and then further treated separately. Non-defective bottles whose degree of soiling is lower than the predetermined degree of soiling can be transported to the bottle outlet 4.

So, the following parameters result at the units 16 of FIG. 1:

$n_1$: number of bottles running into the cleaning module;

$n_2$: number of bottles running into the cleaning machine;

$n_3$: number of bottles to be inspected in unit 3;

$n_4$: number of bottles running out of the cleaning module after inspection;

$n_6$: number of bottles transported to the discharge unit at the inspection;

$n_5$: number of bottles returned to the inlet of the cleaning machine 2 for recleaning after inspection.

Here, n1-n6 are non-negative integers.

Here, it in particular arises that the number of bottles running into the cleaning machine 2 results from the sum of the number of bottles running into the cleaning module for the first time, n1, and the number of returned bottles, $n_5$. Furthermore, the number of the bottles running out of the cleaning module results from the number of bottles inspected in the inspection unit, that means the cleaned bottles, minus the returned bottles and minus the sorted out bottles, if there are any sorted out bottles.

An intelligent control of the cleaning module can be accomplished by means of a control unit, for example a computer (not shown here), which can be connected to the bottle inspection unit 3 or even be suitably integrated into this unit. Here, the control module will in particular evaluate the ratios n5/n3, the number of returned bottles per number of cleaned bottles, and n6/n3, the number of sorted out bottles per number of cleaned bottles, where the adjusted control parameters are taken into consideration. Corresponding to the Sinner Circle of FIG. 3, by the control unit, the cleaning parameters of the cleaning machine 2 can be optimized so that the ratios remain near the determined optimal value parameters for the ratios, or in any case do not exceed them.

Figure 2:
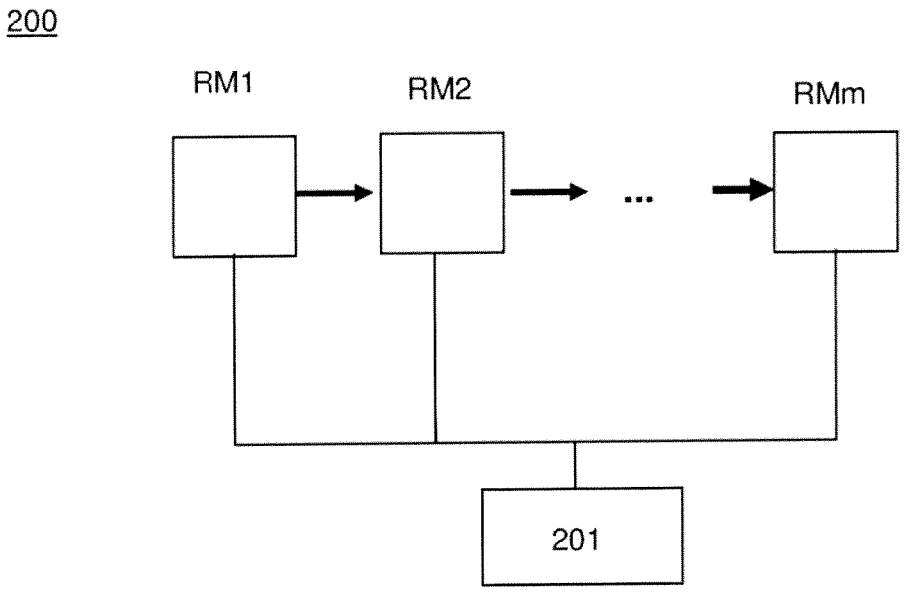
FIG. 2 shows a representation of a further embodiment of the present disclosure with a series connection of several cleaning modules as shown in FIG. 1 and an inventive control of the cleaning modules connected in series.

Several cleaning modules RM1, RM2, . . . RMm of the kind as they are shown in FIG. 1 can be connected in series in a cleaning system with a series connection 200 of cleaning modules RMm, as shown in FIG. 2, for example to realize cleaning jobs with different, typically increasing demands on cleanness. In another further development, FIG. 2 shows an intelligent control 201 for m cleaning modules connected in series 1, . . . , m, which takes into consideration the parameters, i=1, . . . , m, where in particular the parameters $n_{i5}$ and $n_{i6}$ can be weighted differently for each station. Here, $n_{i1}, \ldots, n_{i6}$, i, m are non-negative integers. So, the control unit 201 can optimize the process efficiency for individual cleaning modules each and for the series connection of the m cleaning modules in a self-learning manner.

In one concrete example, the disclosure is to be illustrated with reference to a first step for cleaning standard returnable beer bottles. In this example, in a station for pre-cleaning, a cleaning module according to the disclosure is to accomplish, together with a control unit according to the disclosure, the removal of old labels on the bottles already used at least once. The bottles are introduced into a cleaning machine of the type described above by means of a conveying belt. In the cleaning machine, the old labels are presoaked for a certain time. Here, typically water with an additive of a washing caustic is used, for example a 2-3% caustic. It can prove to be advantageous to heat the water to be used so that thermal energy is additionally used. After presoaking, further steps for detaching the labels are performed, for example the use of compressed water jets. At the end of the cleaning machine, the bottles run into the inspection station in which it is assessed corresponding to the disclosure whether the old labels have been sufficiently removed from the bottles. Optionally, the beer bottles are sorted out into a return means to be cleaned again by the intelligent control. For example, the number of returned bottles should be no more than 20%. However, if the inspection station determines that more than 20% of the cleaned bottles are not yet sufficiently cleaned, that means $n_5/n_3>0,2$, the automatic control of the control unit will change the cleaning parameters corresponding to the Sinner Circle shown in FIG. 3, that means for example increase the concentration of caustic and/or extend the soaking time. Furthermore, bottles can be sorted out by the inspection station in this example. A still tolerable percentage of bottles to be sorted out is, for example, $n_6/n_3\approx0.5\text{-}1\%$. Apart from obviously defective bottles which, however, are possibly already sorted out by previous inspection before the bottles enter the cleaning machine at all, there are in particular bottles where the label does not detach or where soiling is, for example, very severe, or if unexpected damages occur, for example by the machine itself. In this case, too, the inspection station can change the cleaning parameters, for example mechanics or time of action, as described above, to bring the target parameter to less than 1%.

It will be understood that features mentioned in the above described embodiments are not restricted to these special combinations and are also possible in any other combinations. The shown methods and devices are not restricted to applications in the beverage industry but can be employed wherever a single- or multi-step cleaning of containers is advisable.

The invention claimed is:

1. Method of cleaning containers in a cleaning module with a cleaning machine, in which at least one cleaning medium is allowed to act on the containers transported through the cleaning machine, and an inspection unit, comprising:

determining at least one control parameter reflecting a degree of soiling of cleaned bottles;

detecting the degree of soiling of the cleaned bottles;

determining a number of cleaned bottles, $n_3$;

evaluating the detected degree of soiling of the cleaned bottles and returning those cleaned bottles having been evaluated to exhibit an excessive degree of soiling to an inlet of the cleaning machine;

determining a number of returned bottles, $n_5$; and automatically controlling cleaning parameters of the cleaning machine if the number of returned bottles, $n_5$, per the number of cleaned bottles, $n_3$, exceeds one of a first predetermined target value or a first target range.

2. Method according to claim 1, further comprising:

automatically controlling the cleaning parameters of the cleaning machine if the number of returned bottles, $n_5$, per the number of cleaned bottles, $n_3$, falls below one of the first predetermined target value or the first target range.

3. Method according to claim 1, further comprising:

determining at least one further control parameter with respect to a sorting out of cleaned bottles;

detecting a state of the cleaned bottles;

evaluating the detected state of the cleaned bottles in view of the at least one further control parameter with respect to the sorting out, and sorting out bottles for which the at least one further control parameter is exceeded;

determining a number of sorted out bottles, $n_6$; and automatically controlling the cleaning parameters of the cleaning machine if the number of sorted out bottles, $n_6$, per the number of cleaned bottles, $n_3$, exceeds one of a second predetermined target value or a second target range.

4. Method according to claim 3, further comprising:

automatically controlling the cleaning parameters of the cleaning machine if the number of sorted out bottles, $n_6$, per the number of cleaned bottles, $n_3$, falls below one of the second predetermined target value or the second target range.

5. Method according to claim 4, wherein the automatically controlling of the cleaning parameters of the cleaning machine is accomplished by means of a fuzzy logic system.

6. Method according to claim 4, wherein the automatically controlling of the cleaning parameters is accomplished corresponding to the Sinner Circle.

* * * * *